United States Patent [19]

Last et al.

[11] 4,302,485

[45] Nov. 24, 1981

[54] FABRIC TREATMENT WITH ULTRASOUND

[75] Inventors: Anthony J. Last, Oakville; John M. McAndless, Medicine Hat, both of Canada

[73] Assignee: Her Majesty the Queen in right of Canada, as represented by the Minister of National Defence, Canada

[21] Appl. No.: 125,699

[22] Filed: Feb. 28, 1980

[30] Foreign Application Priority Data

Jul. 18, 1979 [CA] Canada ..... 332065

[51] Int. Cl.[3] ..... B05D 3/12; B05D 1/18; B05C 3/12

[52] U.S. Cl. ..... 427/57; 118/419; 118/420; 118/620; 427/389.9; 427/434.6

[58] Field of Search ..... 427/57, 389.9, 434.6; 428/290, 422; 118/419, 420, 620

[56] References Cited

U.S. PATENT DOCUMENTS

| | | | |
|---|---|---|---|
| 3,084,020 | 4/1963 | Loosli | 427/57 X |
| 3,546,187 | 12/1970 | Tandy | 428/422 X |
| 3,870,551 | 3/1975 | Iwami et al. | 427/57 |
| 4,157,420 | 6/1979 | Dourrain et al. | 427/57 X |

*Primary Examiner*—Michael R. Lusignan

*Attorney, Agent, or Firm*—William R. Hinds

[57] ABSTRACT

A method and apparatus for the treatment of fabric materials with a liquid finishing agent such as a liquid repellant is disclosed. The method involves passing a strip of the fabric through a bath of the liquid finishing agent across a stationary fabric contacting surface. In the preferred embodiment, the fabric is subjected to ultra-sonic energy while immersed in the bath at a power level and frequency such that cavitation occurs in the bath adjacent the submerged material.

19 Claims, 4 Drawing Figures

FABRIC TREATMENT WITH ULTRASOUND

Figure 1:
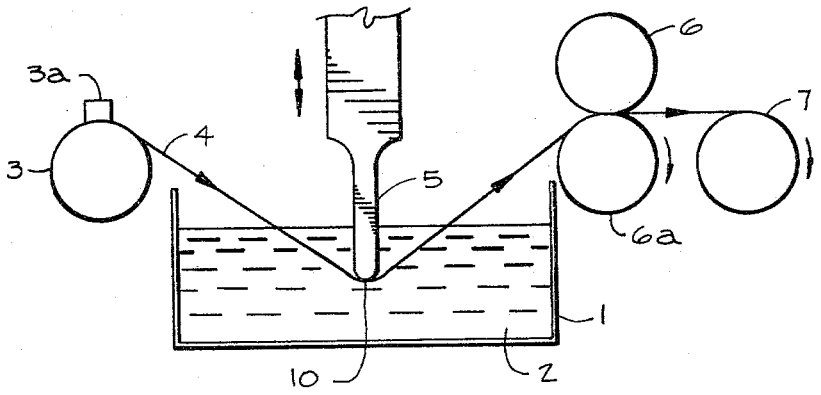

This invention relates to the treatment of fabric materials with a liquid finishing agent e.g. dyes and liquid repellent finishes.

Conventional finishing techniques involve treating various fabric materials by drawing the material through a bath of treating solution, squeezing the treated material in a padding machine under about 60 lbs. roll pressure to remove excess treating solution, repeating the procedure as necessary (e.g. 2 dips/2 nips), air-drying and forced hot air curing. The material is immersed and drawn through the bath with the aid of at least one submerged guide roller.

Military personnel depend on their clothing systems for protection against weather and battlefield hazards. The fabric material used in military clothing requires treatment with a liquid repellent finish to provide protection against wetting by rain and other liquids such as oils, fuels and chemical agents.

Since certain fluorine-containing polymers are unique in their ability to repel both water and oily fluids, these so-called "fluorochemicals" are used extensively in liquid repellent finishes for clothing material. The most common types of fluorochemicals include polymers of fluoroalkyl acrylate and methacrylate esters. These fluorinated materials are extremely expensive; so for reasons of economy and sometimes to bring about an improvement in water repellency, fluorochemicals are often extended with conventional watr repellent compounds in finishing formulations. Certain formulations containing both fluorochemicals and durable water repellents provide fabrics with outstanding protection against rain and confer useful levels of oil repellency when freshly-applied. However, under certain laundering and wearing conditions, fabrics treated with fluorochemical/water repellent finishes rapidly lose oil repellency to a point where it is no longer adequate for military purposes. Furthermore, loss of repellency in these cases has been found to result primarily from changes in chemical configuration of the outermost finish layers and overlaying of fluorinated groups by hydrocarbon groups (the latter groups provide no oil repellency) rather than from substantial loss of finish material. Fabrics treated with fluorochemicals alone generally retain oil repellent properties for longer periods of time on laundering and wearing.

It is also known that ultrasonic energy may be employed to improve the dyeability of fibers, to improve the wash-fastness of crease-resistant finishes and to increase the tanning rate of leather. This work has mainly been performed in ultrasonic tanks similar to ultrasonic cleaning baths which operate at comparatively low power.

According to one aspect of the invention, a method for the treatment of fabric materials with a liquid finishing agent is contemplated, comprising: (a) providing an open-topped container for a bath of liquid finishing agent, (b) guiding the fabric material from a supply position downwardly into the container across a guide means including a stationary fabric contacting surface disposed within said container, to immerse a portion of the length of the fabric material in the bath, (c) applying high frequency sonic energy to the bath in close proximity to the immersed fabric, at a power level and frequency such that effective cavitation occurs in the bath adjacent the immersed material, the frequency being in the range of 5–50 KHz and the power level expressed as power density at the fabric-contacting surface being in the range of 2–10 acoustic watts/cm$^2$, and drawing the fabric material through the bath and outwardly out of the bath.

According to a further aspect of the invention, an apparatus for the treatment of fabric materials with a liquid finishing agent is contemplated, comprising: (a) an open-topped container for a bath of liquid finishing agent, (b) guide means including a stationary fabric-contacting surface disposed within said container, (c) means for drawing the fabric material from a supply position outside the container downwardly into the container across the fabric-contacting surface and upwardly out of the container, and (d) means for applying high frequency sonic energy to the bath in close proximity to the immersed fabric at a power level and frequency such that effective cavitation occurs in the bath adjacent the immersed fabric, said means for applying high frequency sonic energy including a working surface, and said frequency being in the range of 5–50 KHz and said power level expressed as power density at the working surface being in the range of 2–10 watts/cm$^2$, wherein said means for applying high frequency sonic energy comprises ultrasonic generator means, a plurality of matched, driven piezo-electric ceramic material transducers, electrically connected in parallel, said transducers being electrically connected to the generator means, and resonating means including said working surface, for providing even motion amplitude high frequency sonic energy at said working surface. Said working surface may include said stationary fabric-contacting surface.

Other aspects of this invention will be apparent from the ensuing description and the appended claims.

It is believed that the application of high-frequency sonic energy i.e. ultrasound in close proximity to the material causes cavitation which increases the microturbulence within the material and increases the wicking effect by a combination of the variable pressure in the acoustic field and the release from the overall acoustic radiation pressure when it has left the immediate vicinity of the field.

The term cavitation as used herein may be defined as follows: a sonic or ultrasonic wave propagated through a liquid such as water consists of alternate compressions and rarefactions. This creates a rapid movement (agitation) of the liquid due to the rapidly varying sonic pressure. If the acoustic wave has a high-enough amplitude, a phenomenon occurs, known as cavitation, in which small cavities or bubbles form in the liquid phase, due to liquid shear, followed by their rapid collapse. These cavitation bubbles take many cycles to grow to what may be called resonant size, at which point they implode violently in one compression cycle, producing local pressure changes of several thousand atmospheres. This mechanical shock is felt over a distance of a few microns.

It has been found that workable cavitation frequencies are in the range of 5–50 kHz and preferably 20–25 kHz. Cavitation does occur at higher frequencies but not effective cavitation in terms of propagation of shock waves i.e. the bubbles produced are too small to be effective. At the other end of the scale, there is more cavitation below the aforementioned lower limit, but too much noise is produced for practical purposes.

Figure 3:
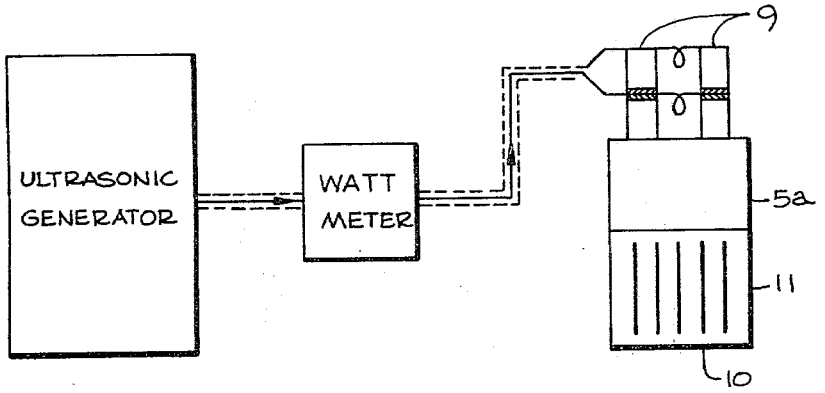
Figure 2:
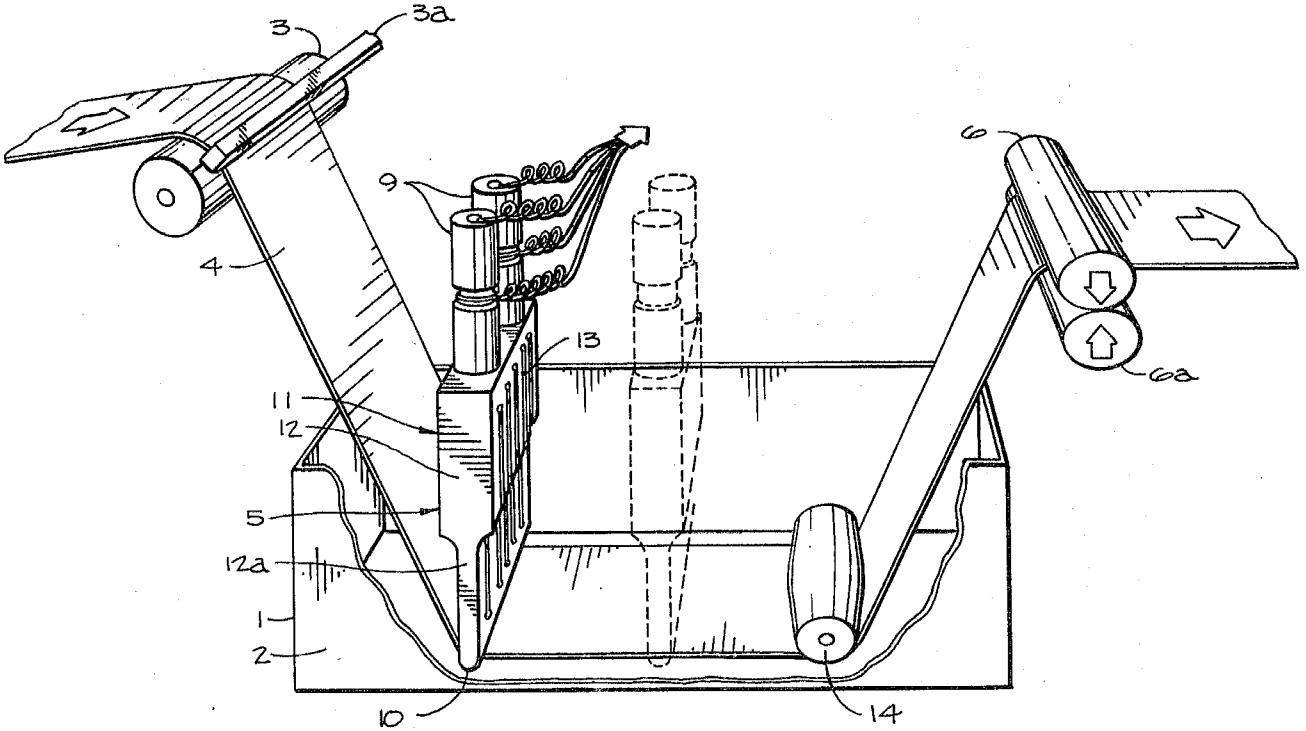
Figure 4:
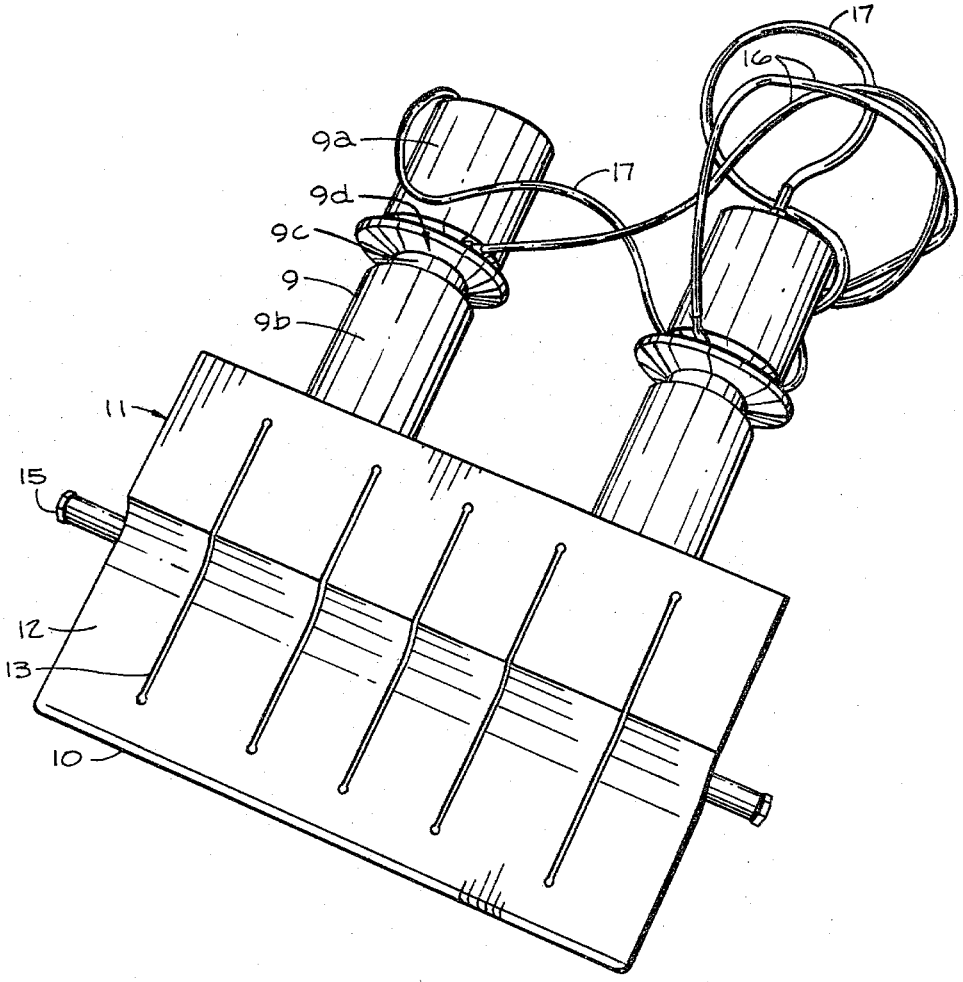

In the drawings which illustrate embodiments of the invention,

FIG. 1 is a side elevation of an apparatus according to the invention, wherein a stationary guide means is employed, FIG. 2 is a side elevation of another embodiment of an apparatus according to the invention, FIG. 3 is a circuit diagram illustrating the ultrasonic equipment according to the invention appearing on the same sheet of drawings as FIG. 1, and FIG. 4 is a perspective view of a means for applying high frequency sonic energy according to the invention.

In the first embodiment of the invention illustrated in FIG. 1, the novel apparatus is seen to comprise an open-topped container 1 for a bath 2 of liquid finishing agent. The liquid finishing agents specifically contemplated include dyes and liquid repellent finishes. However, other solid finishes may be similarly added to a fabric from solution or from a solid suspension in a liquid. Among the liquid repellent finishes, fluorochemical compounds e.g. one known by the trade designation FC-232 (a waterbased fluoropolymer, supplied by the Minnesota Mining and Manufacturing Company) was chosen as being typical of this type of finishing agent. Conveniently a solution of this finish in tap water containing 10% weight (3% solids) at room temperature, was used. Organic solvent based finishes are also contemplated e.g. a finish known by the trade designation Tinotop T-10, a two-component finish consisting of a fluoropolymer (Tinotop 10A) and a polyacrylate adjunct (Tinotop 10B). Each component is supplied as an 8–10% solution by weight in a chlorinated hydrocarbon solvent e.g. perchloroethylene.

A supply of the fabric material 4 is conveniently supported on a conventional roller 3 adjacent one end of the container. A friction pad 3*a* is provided to maintain tension. The fabric material may be woven (textile) or non-woven. In the following experiments, two different fabrics representative of light-weight and heavy-weight fabrics were chosen for treatment with the fluorochemical finish. A first, designated NC-5 is a nylon/-cotton blend comprising a 50/50 twist blend, OG107 dye, 170 $gm^{-2}$ (5 oz $yd^{-2}$) and another designated PC-8 which is a polyester/cotton blend i.e. 65/35 twist blend, OD7 dye 282 $gm^{-2}$ (8.3 oz $yd^{-2}$).

A guide means 5 having a stationary fabric-contacting surface 10 is provided for contacting the fabric 4 and guiding it on a path of travel extending downwardly from roller 3 and into the container 1. The guide means 5 is conveniently fixed in the operating position shown. However, means (not shown) may be provided for lowering and raising the guide means 5, to and from the operating position to facilitate positioning of the fabric in the apparatus. Various conventional means may be employed e.g hydraulic lifts. The fabric-contacting surface 10 is typically a straight edge extending across the width of the fabric 4, being shaped e.g. rounded to minimize fabric damage. It is postulated that such a stationary fabric-contacting surface which also acts as a guide means for the fabric in place of conventional rollers, causes localized pressures produced during contact with the moving fabric which force finishing agent into the fabric structure.

A conventional mangle comprising a pair of rollers 6 and 6*a* conveniently under about 60 lbs roll pressure, located adjacent the other end of the container 1 is provided for guiding the fabric 4 upwardly from guide means 5 and out of the container 1, and for removing excess liquid finishing agent. One of the rollers 6*a*, is driven by drive means (not shown) conveniently a variable speed electric motor, to draw the fabric through the apparatus.

Preferably, conventional means for air-drying (not shown) and heatcuring (not shown) are provided downstream of said mangle.

A take-up roll 7 may be provided for collecting the treated fabric.

As seen in FIGS. 2 and 3, the guide means 5 preferably comprises means for applying high frequency sonic energy 11 and the stationary fabric-contacting surface 10.

As best seen in FIG. 4, the sonic means 11 comprises an ultra sonic generator which drives a plurality of transducers 9. A resonating means in the form of a flat metal step horn 12 is mounted in the bath by means of centre bolts 15 at the nodal points. A plurality of equally spaced slots 13 are provided in the horn 12 to decouple the longitudinal sound waves and to provide an even motion amplitude along the fabric contacting surface 10. The flat step horn acts to concentrate the sound and increases the amplitude of the sound waves. The stepped horn portion 12 is ½ wave length in length and enables the use of lower energy output transducers.

As mentioned previously, the workable cavitation frequencies are in the range of 5–50 kHz and preferably 20–25 kHz. The workable power levels are determined from the net acoustic power output available at the fabric contacting surface 10 and the surface area of the fabric contacting surface.

$$\text{Power density (watts/cm}^2) = \frac{\text{Power output at working surface } (w)}{\text{area of working surface (cm}^2)}.$$

The workable power levels, expressed as power density are in the range of 2–10 watts/$cm^2$.

For some experiments a second sonic means 11 is provided and located between the first sonic means and the crown roller 14. As discussed hereinafter, where two sonic means are employed at least the second may be of lower power output.

Conventional means (not shown) may also be provided for lowering the guide means 5 from an elevated position above the container 1 to the operating position shown within the container.

In FIG. 3, the circuitry for the sonic source is illustrated. The assembly is seen to comprise a conventional ultrasonic generator e.g. a Macrosonics Corporation Model KC 500-1 Multifrequency Generator whose power output is monitored by a conventional wattmeter e.g. a Wave Energy System Wattmeter, Model M1/SCl. A plurality of conventional matched driven piezoelectric lead zirconate titanate ceramic transducers 9, conveniently two, electrically connected in parallel, provide the required vibratory motion. The transducers are electrically connected to the ultrasonic generator through the wattmeter, by means of a coaxial cable in a conventional manner.

With reference to FIG. 4, a 22.8 kHz, 8 inch width sonic source is illustrated. It is seen that the flat step horn 12 is supported at nodal points by a centre bolt 15. The transducers 9 comprise back stub portions 9*a* usually of steel; front stub portions 9*b* of a lighter metal, conveniently aluminum; lead zirconate titanate ceramic portions 9*c* which provide the vibratory motion; and high voltage electrodes 9*d*. The transducers 9 are electrically connected in parallel by conductors 16 from the electrodes 9d to the generator. Conductors 17 are connected to the back stub 9a and ground the transducers through the coaxial cable to the generator.

EXPERIMENTAL

Treatment Solution

A solution containing 10% by weight (3% solids) FC-232 emulsion in tap water at room temperature was used for finishing fabrics. This solution was stable but if it had stood three weeks or more a fresh solution was made up prior to fabric treatment.

Conventional Laboratory Treatment Cycle

Fabric samples of 20 cm ×40 cm size were put through the following standard treatment cycle:

1. Triplicate samples were weighed dry to 0.01 g accuracy and then passed through the treatment solution at a velocity of 2.5 cm per second;
2. The treated fabrics were then passed through the mangle with the rolls set at 27.2 kg (60 lbs) pressure to remove excess solution;
3. In some cases, fabrics were passed through the treatment bath and the mangle a second time (two-dip/-two-nip treatment);
4. Damp samples were weighed as rapidly as possible before any appreciable air drying took place;
5. Weighed, damp samples were hung up on cotton strings to air dry overnight;
6. Air-dried samples were weighed to the nearest 0.01 g and then cured in a laboratory oven at 170° C. for 2 minutes on special racks;
7. Samples were then cooled to room temperature and reweighed.

Treatment Cycle Using Ultrasound

Samples of 20 cm ×40 cm size were put through the standard treatment cycle as described above with the following variations:

1. Tx-Contact: fabrics were pulled through the treating solution while rubbing against the stationary fabric-contacting working surface of a source of high frequency sonic energy.
2. Tx-Remote: the fabric was kept at least 1 cm away from the working face of the immersed transducer blade as the sample was passed through the treatment bath.
3. Both Tx-Contact and Tx-Remote tests were run with and without ultrasound for comparison purposes.
4. Fabrics were insonated at frequencies of 8.69 kHz, 22.80 kHz and 46.60 kHz.
5. Ultrasonic power levels were chosen to include high power (over 100 watts net) in the cavitation range and moderate power (approximately 15 watts net) below the cavitation range.

Ultrasonic Equipment 8.7-kHz and 22.8/47.6-kHz transducers were designed and built for use in this study. These transducers were driven at the indicated frequencies by a Macrosonics Corporation Model KC 500-1 Multifrequency Generator with power levels monitored by a Wave Energy Systems Wattmeter, Model M1/SG1. The general layout of the equipment and the operation of the appropriate transducer in the Tx-Contact mode is illustrated in FIG. 3.

The acoustic power levels as determined by power density at the working surface are (1) for 8.7 kHz=(110/30.1)=3.65 w/cm$^2$ (2) for 22.8 kHz=(115/25.8)=4.46 w/cm$^2$ By contrast, the power density for 22.8 kHz without cavitation=(14/25.8)=0.54 w/cm$^2$.

RESULTS

Fabric Finishing Using Ultrasound

Three identical samples of both the aforementioned light- and heavy-weight military fabrics were treated with fluorochemical for each of the three types of treatment cycles (Tx-Remote, Tx-Contact and U/S-Tx-Contact) described previously. The Tx-Remote cycle, since it involves neither contact between the fabric and transducer nor use of ultrasound, is analogous to the standard method of laboratory fabric treatment. (Commercial treatment usually has a faster speed). Individual samples were numbered and each group of three fabrics run through a given treatment cycle was designated as a series (A, B, etc.) to facilitate comparison of results.

TABLE I

Nylon-Cotton (NC-5) Summary of Finishing Results Using Different Treatment Cycles

| Sample | | Dip & | Treatment | Add-On | | U/S Frequency | U/S Power Level | |
|---|---|---|---|---|---|---|---|---|
| | | | | Wet Pickup[c] | Net Gain[d] | | In | Net |
| No.s | Series | Nip | Cycle | (%) | (%) | (kHz) | (W) | (W) |
| 1, 2, 3, | A | 2 | Tx-Remote | 96.59 | 2.98 | — | — | — |
| 4, 5, 6, | B | 2 | TX-Contact | 109.38 | 4.92 | — | — | — |
| 7, 8, 9, | C | 1 | U/S-Tx-Remote | 104.26 | 3.68 | 22.80 | 200 | 115 |
| 10, 11, 12 | D | 1 | U/S-Tx-Contact | 99.09 | 4.52 | 22.80 | 200 | 115 |
| 13, 14, 15 | E | 1 | Tx-Contact | 18.61[e] | 2.78 | — | — | — |
| 16, 17, 18 | F | 1 | U/S-Tx-Contact | — | 2.87 | 8.69 | 25 | 14 |
| 19, 20, 21 | G | 1 | U/S-Tx-Contact | — | 4.44 | 8.69 | 200 | 110 |
| 22 | H | 1 | Extra Control | 97.31 | 2.98 | — | — | — |
| 23, 24, 25 | I | 1 | Tx-Remote | 104.82 | 3.13 | — | — | — |
| 26, 27, 28 | J | 1 | Tx-Contact | 98.29 | 3.42 | — | — | — |
| 32, 33, 34 | L | 1 | U/S-Tx-Contact | 101.46 | 4.12 | 46.60 | 200 | 110 |

[c]Average of three samples; [(damp weight treated - originalweight)/original weight] × 100

[d]Average of three samples; [(cured weight treated - original weight)/original weight] × 100

[e]Samples in this series were not weighed immediately following passage through the treatment bath and padder. The weighings took place after the samples had air dried for 45 minutes. Sample 22 was run through and check weighed immediately.

TABLE II

Polyester-Cotton (PC-8): Summary of Finishing Results Using Different Treatment Cycles

| Sample Nos. | Series | Dip & Nip | Treatment Cycle | Add-On Wet Pickup (%) | Add-On Net Gain[d] (%) | U/S Frequency (kHz) | U/S Power Level IN (W) | U/S Power Level Net (W) |
|---|---|---|---|---|---|---|---|---|
| 1, 2, 3 | A | 2 | Tx-Remote | 75.63 | 1.77 | — | — | — |
| 4, 5, 6 | B | 2 | Tx-Contact | 88.56 | 3.41 | — | — | — |
| 7, 8, 9 | C | 1 | U/S-Tx-Remote | 80.58 | 2.77 | 22.80 | 200 | 115 |
| 10, 11, 12 | D | 1 | U/S-Tx-Contact | 75.26 | 3.88 | 22.80 | 200 | 115 |
| 13, 14, 15 | E | 1 | Tx-Contact | 21.69[e] | 2.11 | — | — | — |
| 16, 17, 18 | F | 1 | U/S-Tx-Contact | — | 2.20 | 8.69 | 24 | 14 |
| 19, 20, 21 | G | 1 | U/S-Tx-Contact | — | 3.68 | 8.69 | 200 | 110 |
| 22 | H | 1 | Extra Control | 79.96 | 2.18 | — | — | — |
| 23, 24, 25 | I | 1 | Tx-Remote | 87.74 | 1.61 | — | — | — |
| 26, 27, 28 | J | 1 | Tx-Contact | 82.26 | 2.00 | — | — | — |
| 32, 33 34 | L | 1 | U/S-Tx-Contact | 80.72 | 2.59 | 46.60 | 200 | 110 |

Finish Add-On

The results of insonating the nylon/cotton and polyester/cotton fabrics at different frequencies and power levels during the finishing process are summarized in Tables I and II, respectively.

Both types of fabric display similar results for each of the treatment cycles examined. In general, a marked increase in weight of finish add-on occurs when the fabric contacts the stationary fabric-contacting surface of the guide means during transport through the fluorochemical bath, as shown by comparing series A, B and I, J. A comparison of A and G reveals that the use of ultrasound alone improves finish add-on. It is also apparent that the best results are obtained when employing both contact with a stationary fabric-contacting surface and ultrasound. The results also indicate that a single dip/nip treatment using an ultrasound assisted contact mode at high ultrasound power yields about the same level of finish add-on for the given fluorochemical concentration as a two-dip/two-nip contact mode without ultrasound (series B compared to D). For the lightweight nylon-cotton fabric, the ultrasonic frequency used with the Tx-contact method over the range examined does not appear to be of prime importance in promoting this effect provided enough power is used (e.g. above 100 watts) to ensure cavitation is occuring. Comparing contact mode tests carried out at 8.69 kHz (series F and G) shows the benefits of using power levels in the cavitation range to promote increased finish add-on. In the case of the polyester/cotton fabric, (Table II) high power levels and lower frequencies, i.e. 8.69 and 22.8 kHz, used with the contact mode appear to produce greater increases in finish add-on compared to contact runs carried out at 46.6 kHz.

In the present study, insonation of fabrics during the treatment process generally produced an increase in finish add-on compared to cases where no ultrasound was employed. Provided power levels sufficient to produce cavitation in the treating solution were employed, the increased add-on did not appear to be a function of ultrasonic frequency over the range of frequencies examined.

More important, however, is the fact that, for a given treatment bath concentration, a method utilizing contact between the moving fabric and a stationary fabric-contacting surface in the treating solution can produce as much or more finish add-on in a single pass as the standard twodip/two-nip method. Such a method has definite economic advantages in cases where fabrics require treatment with expensive fluorochemical finishes. That is, with the contact method of treatment. It was felt that the above results warranted the examination of the effects of various parameters including concentration of the bath and an operation speed which matches that of conventional industrial practice as well as a faster speed. The two ultrasonic transducers of 22.8 KHz and 8.7 KHz made for the precious work were used at power levels that gave good cavitation i.e. sufficient power levels to achieve clear cavitation at the fabric contacting surface. The 22.8 KHz transducer was driven by an E.N.1. 1140L Power Amplifier through an E.N.I. Piezoelectric Transducer Matchbox for impedance matching the generator to the transducer. The 8.7 KHz transducer was driven by a Macrosonics Corporation Model KC 500-1 Multifrequency Generator with power levels monitored by a Wave Energy Systems Wattmeter, Model M1/SC1.

Fabric samples were treated using conventional methods and the various samples were compared with respect to their physical properties, liquid repellency and durability of liquid repellency to wearing.

MATERIALS USED

Chemicals

Fluorochemical FC-232 was used as the liquid repellent finish during this study. This finish is a water-based fluoropolymer, supplied by 3M ®Company as an emulsion of 3% solids by weight.

Fabrics

Two nylon/cotton fabrics of different weights were chosen for treatment with the fluorochemical finish. These fabrics were representative of the types used in military clothing and equipment systems.

TABLE III

FABRICS USED IN FINISHING STUDIES

| Designation | Fabric | Description |
|---|---|---|
| A | Nylon/Cotton | X74-438 (5oz/yd) |
| B | Nylon/Cotton | Text 7-6-5 (8oz/yd) |

FABRIC FINISHING

Treatment Solution

Three solutions containing 10%, 5% and 1.6% by weight of FC-232 emulsion in tap water at room temperature was used for finishing fabrics. This represented 3%, 1½% and ½% solids. The final tests were made with 2% volume Iso-Propanol added to the 3% solids treatment solution.

Treatment Cycle

Fabric samples were cut to 122 cm×20 cm strips and put through the following treatment cycles:

Triplicate samples were weighed dry to 0.001 g accuracy and then passed through the treatment solution at 0.5% solids, 1.5% solids, and 3% solids concentration. Two velocities of 1 ft/sec (a typical commercial washing speed) and 2 ft/sec were used for the treatments.

The rolls 6 and 6*a* for the strip also served as the padding rolls set at 27.2 kg (60 lbs) weight to remove excess solution. The padding rolls consisted of one driven roll 6, with an internal motor, and an idler roll 6*a*. The driven roll could be operated at 30 cm/sec (1 ft/sec) or 60 cm/sec (2 ft/sec) with a simple transfer of drive rolls.

A leader strip and follower strip were attached to the sample by sewing in order to allow the fabric sample to reach its operating velocity and to maintain both a front and back tension on the sample when travelling through the bath.

The strip unrolled from a feed roll 3, limited in motion by a friction pad 3*a* in order to add back-tension to the strip. The strip proceeded downward into the bath under a stationary fabric contacting surface 10, thence to a partially immersed crown roll 14 to keep the strip centred. From there it proceeded out of the bath and through the padding rolls. For later tests a second blade-type transducer was added between the first transducer and the crown roll.

The samples were air dried and weighed to the nearest 0.001 g and then cured in a laboratory oven at 175° C. for 2 minutes on special racks.

The samples were then cooled to room temperature and re-weighed.

Treatment Cycle Using Ultrasound

The fabrics were insonated at 22.8 KHz with 175 watts (net) well within the cavitation range. The power density for this arrangement is 175/25.8=6.8 w/cm$^2$.

The additional transducer added for later tests resonated at 8.7 KHz and a power level of 175 watts (net) was used.

EQUIPMENT

Wearing Tests

The effect of wearing on fabric liquid repellency was examined using an experimental wearing machine. Fabric samples (18 cm×27.5 cm) were sewn into an endless belt and passed over the brushes and rollers of the machine under 0.5 kg tension. Wearing tests were carried out under controlled temperature and humidity conditions; viz. 22° C. and 55% relative humidity. Repellency tests were carried out at regular intervals on the worn fabrics.

Water Repellency

The water repellency of treated fabrics was measured according to AATCC 22-1967 Standard Spray Test by pouring 250 ml of water through a spray nozzle onto a fabric sample and comparing the wetting pattern with a standard rating chart (Rating scale 0–100).

Oil Repellency

Oil repellency was measured using a modified AATCC hydrocarbon-resistance test. The modified test comprises carefully placing a small drop of each of the hydrocarbon liquids listed in Table IV on the fabric sample which is lying on a flat horizontal surface. Any penetration or wicking into the fabric was noted visually after five minutes. The oil repellency rating of the fabric was recorded as the highest-numbered test liquid which did not wet the fabric after this time. With this test (rating scale 0–7), a rating of 5 or higher is considered good; a fabric with a rating of less than this can be wetted rapidly by most common fuels and low-viscosity oils.

TABLE IV

OIL-REPELLENCY TEST LIQUIDS

| Rating Number | Hydrocarbon Liquid | Proportions |
|---|---|---|
| 1 | Nujol | |
| 2 | Nujol/n-hexadecane | 65/35 |
| 3 | n-hexadecane | |
| 3/4 | n-hexadecane/n-tetradecane | 50/50 |
| 4 | n-tetradecane | |
| 4/5 | n-tetradecane/n-dodecane | 50/50 |
| 5 | n-dodecane | |
| 5/6 | n-dodecane/n-decane | 50/50 |
| 6 | n-decane | |
| 6/7 | n-decane/n-octane | 50/50 |
| 7 | n-octene | |

Phosphate Resistance

The resistance of treated fabrics to wetting by organo-phosphorus liquids was determined in a manner similar to the oil-repellency test. Small drops of the model test liquids trimethyl phosphate, triethyl phosphate and trin-propyl phosphate were placed on a flat fabric sample. After one hour, the appearance of each drop was noted visually and a rating assigned to the fabric based on the overall appearance of the three types of droplets (rating scale 0–9). A rating of 7 or above is considered good and means at least two of the three phosphate liquids have shown no signs of wetting or penetrating into the fabric. A rating of less than 4 indicates the fabric has been wetted to some extent by all three of the liquids.

RESULTS

Triplicate samples of both the lightweight and heavyweight military fabrics were treated with fluorochemical at two velocities through the bath (1 and 2 ft/sec) with ½, 1½, and 3% solids in the bath. Identical tests were done with and without ultrasound and the results compared.

Nomenclature

The code on each cloth consisted of four to six separate figures:

1. A=light weight fabric (5 ox/yd) B=heavy weight fabric (8 ox/yd)
2. U=ultrasound, one probe in bath UU=two probes in bath No code at all means that no ultrasound was used.

3. Concentration 3P=3% solids; 1.5P=1.5% solids; 0.5P=0.5% solids
4. Speed of strip 2=1 ft/sec; 3=2 ft/sec.
5. Roman numerals indicating which sample of the triplicate run, i.e. 1=first run; 11=second run; 111=third run
6. 2WA prior to the sample number indicates that 2% Iso-Propanol has been added to the fluorochemical solution.

Preliminary Test with Water

A short preliminary test was run with water and the 8 ox/yd material. The load on the padding rolls was altered from 60 lbs. to 10 lbs to see what influence both speed and load have on water take-up by the material. Table V gives the results of the test.

TABLE V

RESULTS OF WATER TEST

| Test No. | Load lbs | Speed ft/sec | Dry Weight Gms | Wet Weight Gms | % $H_2O$ |
|---|---|---|---|---|---|
| 1 | 60 | 1 | 64.4 | 121.7 | 89 |
| 2 | 60 | 1 | 65.8 | 123.2 | 87 |
| 3 | 10 | 1 | 66.2 | 139.1 | 110 |
| 4 | 60 | 2 | 64.3 | 122.8 | 91 |
| 5 | 10 | 2 | 67.5 | 141.0 | 108 |

This shows that padding load has a greater effect on water pick-up than the speed of the material through the rolls.

Finish Add-on

The results of insonating the light and heavy weight nylon/cotton fabrics are summarized in Tables VI to VIII.

Table VI shows the comparison of the averaged results at 1 ft/sec and 3% solids concentration, and Table VII gives a comparison of the averaged results at 2 ft/sec and the same 3% solids concentration. Table VIII is a comparison of 1.5% solids concentration at both strip speeds.

The main conclusion that can be drawn from the weight results is that the concentration of the fluorochemical solids has a more marked effect on the percentage add-on than does the strip velocity within our experimental boundaries.

More specifically, with reference to Table VI and VII, a comparison of tests (1 and 2) and (4 and 5) shows that ultra sound improves the add-on. A comparison of tests (1 and 7) and (4 and 12) shows that speed alone appears to improve take up. A comparison of tests (2 and 9) shows that ultra sound has more effect than increased speed. A comparison of tests (7 and 8) shows that the presence of wetting agent does not appear to improve add-on. At the faster speed, the usefulness of a second insonating means is considerably reduced. Compare tests (2 and 3) with (9 and 10).

Referring to Table VIII, it is apparent that the effect of U/S is less pronounced at 1.5% than at 3% concentration. It also shows that at higher speeds there is less add-on at the lower concentration for both fabrics. This suggests that concentration should not be reduced to this level.

TABLE VI

Comparison at 1 ft/sec Strip Speed and 3% Concentration

| Sample | U/S | Strip Velocity ft/sec | Concentration % | Average Air-Dried Add-on % |
|---|---|---|---|---|
| 1. A-3P-2 | | 1 | 3 | 4.1 |
| 2. A-U-3P-2 | | 1 | 3 | 4.5 |
| 3. A-UU-3P-2 | | 1 | 3 | 5.3 |
| 4.B-3P-2 | | 1 | 3 | 3.2 |
| 5. B-U-3P-2 | | 1 | 3 | 3.3 |
| 6. B-UU-3P-2 | | 1 | 3 | 4.4 (Ave. of 2) |

TABLE VII

Comparison at 2 ft/sec Strip Speed and 3% Concentration

| Sample | U/S | Strip Velocity ft/sec | Concentration % | Average Air Dried Add-on % |
|---|---|---|---|---|
| 7. A-3P-3 | | 2 | 3 | 4.6 |
| 8. A-3P-3-2WA | | 2 | 3 | 4.4 |
| 9. A-U-3P-3 | | 2 | 3 | 4.4 |
| 10. A-UU-3P-3 | | 2 | 3 | 4.8 |
| 11. A-UU-3P-3-2WA | | 2 | 3 | 4.4 |
| 12. B-3P-3 | | 2 | 3 | 4.1 |
| 13. B-U-3P-3 | | 2 | 3 | 4.2 |
| 14. B-UU-3P-3 | | 2 | 3 | 4.1 |

TABLE VIII

Comparison at 1 + 2 ft/sec Strip Speed and 1.5% Concentration

| Sample | U/S | Velocity ft/sec | Concentration % | Average Air Dried Add-on % |
|---|---|---|---|---|
| A-1.5P-2 | | 1 | 1.5 | 2.9 |
| A-U-1.5P-2 | | 1 | 1.5 | 3.2 |
| B-1.5P-2 | | 1 | 1.5 | 3.1 |
| B-U-1.5P-2 | | 1 | 1.5 | 3.1 |
| A-1.5P-3 | | 2 | 1.5 | 3.1 |
| A-U-1.5P-3 | | 2 | 1.5 | 2.5 |
| B-1.5P-3 | | 2 | 1.5 | 2.6 |
| B-U-1.5P-3 | | 2 | 1.5 | 2.7 |

Wearing Test Results

The experimental wearing machine used in this study subjects fabric samples to several different kinds of wearing action during each cycle and is useful for comparing the durability of finishes on a common substrate under controlled conditions of fabric tension, humidity and temperature.

Tables IX to XIX show the wearing results obtained with the fluorochemical treated nylon-cotton fabrics of both weights. The light fabric, A, shows a significant improvement of phosphate resistance after 20 wearing hours when ultrasound is used at normal (3% solids) chemical concentration and strip velocity i.e. 1 ft/sec. (see Table IX). This result does not appear to hold as true with the heavier fabric, B. The wear results with ultrasound are also improved for the light fabric at the faster strip speed (2 ft/sec) and even at lower chemical concentrations. The addition of a wetting agent with ultrasound also improved the phosphate resistance with the light fabric at the high strip velocity to a point where it is much better than the control without ultrasound and wetting agent and is perhaps marginally better than the control at half the strip velocity.

TABLE IX

WEARING TESTS - A FABRIC

| Fabric Identification | Sample Number | Original Reading | Wear Number - DREO - Hours 4 | 8 | 12 | 16 | 20 |
|---|---|---|---|---|---|---|---|
| | | 100 | 90 | 80 | 80 | 80 | 80 |
| | 1 | 5 | 4/5 | 4/5 | 4/5 | 4/5 | 4/5 |
| | | 5 | 4 | 4 | 1 | 0 | 0 |
| | | 100 | 90 | 80 | 80 | 80 | 80 |
| A-3P-2 | 11 | 5 | 5 | 4/5 | 4/5 | 4/5 | 4/5 |
| | | 6 | 5 | 5 | 4 | 1 | 0 |
| | | 100 | 90 | 80 | 80 | 80 | 80 |
| | 111 | 5 | 4/5 | 4/5 | 4/5 | 4/5 | 4/5 |
| | | 7 | 4 | 4 | 4 | 1 | 0 |
| | | 100 | 90 | 80 | 80 | 80 | 80 |
| | 1 | 5 | 5/6 | 5 | 4/5 | 4/5 | 4/5 |
| | | 9 | 8 | 6 | 6 | 5 | 2 |

TABLE IX-continued

| Fabric Identification | Sample Number | Original Reading | Wear Number - DREO - Hours 4 | 8 | 12 | 16 | 20 |
|---|---|---|---|---|---|---|---|
| | | 100 | 90 | 80 | 80 | 80 | 80 |
| A-U-3P-2 | 11 | 5/6 | 5/6 | 5 | 4/5 | 4/5 | 4 |
| | | 8 | 8 | 4 | 6 | 6 | 2 |
| | | 100 | 90 | 80 | 80 | 80 | 80 |
| | 111 | 5/6 | 5/6 | 5 | 4/5 | 4/5 | 4/5 |
| | | 9 | 5 | 5 | 5 | 5 | 3 |
| | | 100 | 80 | 80 | 80 | 80 | 70 |
| | 1 | 5/6 | 5 | 5 | 5 | 5 | 4/5 |
| | | 9 | 6 | 6 | 6 | 6 | 6 |
| A-UU-3P-2 | | 100 | 90 | 80 | 80 | 80 | 80 |
| | 11 | 5/6 | 5/6 | 5/6 | 5 | 5 | 4/5 |
| | | 9 | 6 | 6 | 6 | 6 | 6 |
| | | 100 | 90 | 80 | 80 | 80 | 80 |
| | 111 | 5/6 | 5/6 | 5/6 | 5 | 5 | 4 |
| | | 9 | 6 | 6 | 6 | 6 | 3 |

(1) Water Repellency
(2) Oil Repellency
(3) Phosphate Resistance

TABLE XI

| Fabric Identification | Sample Number | Original Reading | Wear Number - DREO - Hours 4 | 8 | 12 | 16 | 20 |
|---|---|---|---|---|---|---|---|
| | | 100 | 80 | 80 | 70 | 70 | 70 |
| | I | 4 | 3 | 2 | 2 | 2 | 1 |
| | | 0 | 0 | 0 | 0 | 0 | 0 |
| | | 100 | 80 | 80 | 70 | 70 | 70 |
| A-1.5P-2 | II | 4 | 3 | 2 | 2 | 2 | 1 |
| | | 0 | 0 | 0 | 0 | 0 | 0 |
| | | 100 | 80 | 80 | 70 | 70 | 70 |
| | III | 4 | 3 | 2 | 2 | 2 | 1 |
| | | 0 | 0 | 0 | 0 | 0 | 0 |
| | | 100 | 80 | 80 | 70 | 70 | 70 |
| | I | 5 | 4/5 | 4/5 | 4/5 | 4 | 2 |
| | | 7 | 1 | 0 | 0 | 0 | 0 |
| | | 100 | 80 | 80 | 70 | 70 | 70 |
| A-U-1.5P-2 | II | 5 | 4/5 | 4/5 | 4/5 | 4 | 2 |
| | | 7 | 1 | 0 | 0 | 0 | 0 |
| | | 100 | 80 | 80 | 70 | 70 | 70 |
| | III | 5 | 4/5 | 4/5 | 4/5 | 4 | 2 |
| | | 9 | 0 | 0 | 0 | 0 | 0 |
| | | 100 | 80 | 70 | 70 | 70 | 70 |
| | I | 4/5 | 4 | 4 | 2 | 2 | 2 |
| | | 4 | 0 | 0 | 0 | 0 | 0 |

TABLE X

| Sample Identification | Sample Number | Original Reading | Wear Number - DREO - Hours 4 | 8 | 12 | 16 | 20 |
|---|---|---|---|---|---|---|---|
| | | 100 | 80 | 80 | 80 | 80 | 70 |
| | 1 | 4/5 | 4 | 4 | 3/4 | 3/4 | 3/4 |
| | | 1 | 0 | 0 | 0 | 0 | 0 |
| A-3P-3 | | 100 | 80 | 80 | 80 | 80 | 70 |
| | 11 | 4 | 4 | 4 | 3/4 | 3/4 | 3/4 |
| | | 1 | 0 | 0 | 0 | 0 | 0 |
| | | 100 | 80 | 80 | 80 | 80 | 70 |
| | 111 | 4 | 4 | 4 | 3/4 | 3/4 | 3/4 |
| | | 1 | 0 | 0 | 0 | 0 | 0 |
| | | 100 | 80 | 80 | 80 | 80 | 70 |
| | 1 | 5 | 4 | 4 | 3/4 | 3 | 3 |
| | | 5 | 0 | 0 | 0 | 0 | 0 |
| A-U-3P-3 | | 100 | 80 | 80 | 80 | 80 | 70 |
| | II | 5 | 4 | 4 | 3/4 | 3/4 | 3/4 |
| | | 5 | 0 | 0 | 0 | 0 | 0 |
| | | 100 | 80 | 80 | 80 | 80 | 70 |
| | III | 4 | 4 | 4 | 3/4 | 3/4 | 3/4 |
| | | 1 | 0 | 0 | 0 | 0 | 0 |
| | | 100 | 80 | 80 | 80 | 80 | 70 |
| | I | 4/5 | 4/5/ 4/5 | 3/4 | 3/4 | 3/4 | |
| | | 9 | 4 | 0 | 0 | 0 | 0 |
| | | 100 | 80 | 80 | 80 | 80 | 70 |
| A-UU-3P-3 | II | 4/5 | 4/5 | 4/5 | 3/4 | 3/4 | 3/4 |
| | | 9 | 5 | 0 | 0 | 0 | 0 |
| | | 100 | 80 | 80 | 80 | 80 | 70 |
| | III | 4/5 | 4/5 | 4/5 | 3/4 | 3/4 | 3/4 |
| | | 9 | 5 | 1 | 1 | 0 | 0 |
| | | 100 | 90 | 80 | 80 | 70 | 70 |
| | I | 4 | 3 | 3 | 2 | 2 | 2 |
| | | 0 | 0 | 0 | 0 | 0 | 0 |
| | | 100 | 90 | 80 | 80 | 70 | 70 |
| A-3P-3-2Wa | II | 3/4 | 3 | 3 | 2 | 2 | 2 |
| | | 0 | 0 | 0 | 0 | 0 | 0 |
| | | 100 | 90 | 80 | 80 | 70 | 70 |
| | III | 3/4 | 3 | 3 | 2 | 2 | 2 |
| | | 0 | 0 | 0 | 0 | 0 | 0 |
| | | 100 | 80 | 80 | 70 | 70 | 70 |
| | I | 5 | 4/5 | 4/5 | 4 | 3 | 2 |
| | | 9 | 2 | 1 | 1 | 1 | 1 |
| | | 100 | 80 | 80 | 70 | 70 | 70 |
| A-UU-3P-3-2Wa | II | 5 | 4/5 | 4/5 | 4 | 3 | 2 |
| | | 9 | 0 | 0 | 0 | 0 | 0 |
| | | 100 | 80 | 80 | 70 | 70 | 70 |
| | III | 5 | 4/5 | 4/5 | 4 | 3 | 2 |
| | | 9 | 2 | 2 | 2 | 1 | 1 |

(1) Water Repellency
(2) Oil Repellency
(3) Phosphate-Resistance

TABLE XI-continued

WEARING TESTS - A FABRIC

| Fabric Identification | Sample Number | Original Reading | Wear Number - DREO - Hours 4 | 8 | 12 | 16 | 20 |
|---|---|---|---|---|---|---|---|
| A-1.5P-3 | | 100 | 80 | 70 | 80 | 70 | 70 |
| | II | 4/5 | 4 | 4 | 2 | 2 | 2 |
| | | 4 | 0 | 0 | 0 | 0 | 0 |
| | | 100 | 80 | 70 | 70 | 70 | 70 |
| | III | 4 | 3/4 | 3 | 2 | 2 | 2 |
| | | 4 | 0 | 0 | 0 | 0 | 0 |
| | | 100 | 80 | 80 | 70 | 70 | 70 |
| | I | 4 | 4 | 4 | 2 | 2 | 2 |
| | | 7 | 0 | 0 | 0 | 0 | 0 |
| | | 100 | 80 | 80 | 70 | 70 | 70 |
| A-U-1.5P-3 | II | 5 | 5 | 4/5 | 2 | 2 | 2 |
| | | 9 | 0 | 0 | 0 | 0 | 0 |
| | | 100 | 80 | 80 | 80 | 70 | 70 |
| | III | 4/5 | 4/5 | 4/5 | 2 | 2 | 2 |
| | | 9 | 0 | 0 | 0 | 0 | 0 |

(1) Water Repellency
(2) Oil Repellency
(3) Phosphate-Resistance

TABLE XV

WEARING TESTS - A FABRIC

| Fabric Identification | Sample Number | Original Reading | WEAR NUMBER - DREO - HOURS 4 | 8 | 12 | 16 | 20 |
|---|---|---|---|---|---|---|---|
| | | 80 | 70 | 70 | 70 | 0 | 0 |
| | I | 2 | 1 | 1 | 1 | 1 | 1 |
| A-0.5P-2 | | 0 | 0 | 0 | 0 | 0 | 0 |
| | | 80 | 70 | 70 | 70 | 0 | 0 |
| | II | 2 | 2 | 1 | 1 | 1 | 1 |
| | | 0 | 0 | 0 | 0 | 0 | 0 |
| | | 80 | 80 | 70 | 70 | 0 | 0 |
| | III | 2 | 1 | 1 | 1 | 1 | 1 |
| | | 0 | 0 | 0 | 0 | 0 | 0 |
| | | 80 | 80 | 80 | 70 | 0 | 0 |
| | I | 4 | 3/4 | 2 | 1 | 1 | 1 |
| | | 0 | 0 | 0 | 0 | 0 | 0 |
| A-U-0.5P-2 | | | | | | | |
| | II | — | 80 | 80 | 70 | 0 | 0 |
| | | — | 3/4 | 2 | 1 | 1 | 1 |
| | | — | 0 | 0 | 0 | 0 | 0 |
| | | 80 | 80 | 70 | 70 | 70 | 70 |
| | III | 4 | 2 | 2 | 2 | 2 | 2 |
| | | 0 | 0 | 0 | 0 | 0 | 0 |

(1) WATER REPELLENCY
(2) OIL REPELLENCY
(3) PHOSPHATE-RESISTANCE

TABLE XVI

WEARING TESTS - B FABRIC

| Fabric Identification | Sample Number | Original Reading | Wear Number - DREO - Hours 4 | 8 | 12 | 16 | 20 |
|---|---|---|---|---|---|---|---|
| | | 100 | 90 | 80 | 80 | 80 | 70 |
| | I | 5/6 | 5/6 | 5 | 4/5 | 4/5 | 4/5 |
| | | 9 | 8 | 8 | 4 | 4 | 1 |
| | | 100 | 90 | 80 | 80 | 80 | 70 |
| B-3P-2 | II | 5/6 | 5/6 | 5 | 4/5 | 4/5 | 4/5 |
| | | 9 | 6 | 6 | 4 | 4 | 1 |
| | | 100 | 90 | 80 | 80 | 70 | 70 |
| | III | 5/6 | 5/6 | 5 | 4/5 | 4/5 | 4/5 |
| | | 9 | 8 | 5 | 4 | 4 | 1 |
| | | 100 | 90 | 80 | 80 | 80 | 80 |
| | I | 5 | 5 | 4/5 | 4/5 | 4/5 | 4 |
| | | 9 | 4 | 4 | 1 | 1 | 1 |
| | | 100 | 90 | 80 | 80 | 80 | 80 |
| B-U-3P-2 | II | 5 | 5 | 4/5 | 4/5 | 4/5 | 4 |
| | | 9 | 4 | 4 | 1 | 1 | 1 |
| | | 100 | 90 | 80 | 80 | 80 | 80 |
| | III | 5/6 | 5/6 | 4/5 | 4/5 | 4/5 | 4/5 |
| | | 9 | 4 | 4 | 4 | 1 | 1 |
| | | 100 | 90 | 80 | 70 | 70 | 70 |

TABLE XVI-continued

WEARING TESTS - B FABRIC

| Fabric Identification | Sample Number | Original Reading | Wear Number - DREO - Hours 4 | 8 | 12 | 16 | 20 |
|---|---|---|---|---|---|---|---|
| | I | 5/6 | 4/5 | 4/5 | 4 | 3/4 | 3/4 |
| | | 9 | 4 | 4 | 4 | 0 | 0 |
| B-UU-3P-2 | | 100 | 90 | 80 | 70 | 70 | 70 |
| | II | 5 | 4 | 4 | 4 | 3/4 | 3/4 |
| | | 9 | 4 | 4 | 4 | 0 | 0 |

(1) WATER REPELLENCY
(2) OIL REPELLENCY
(3) PHOSPHATE-RESISTANCE

TABLE XVII

WEARING TESTS - B FABRIC

| Fabric Identification | Sample Number | Original Reading | Wear Number - DREO - Hours 4 | 8 | 12 | 16 | 20 |
|---|---|---|---|---|---|---|---|
| B-3P-3 | I | 100 | 80 | 80 | 70 | 70 | 70 |
| | | 5 | 4/5 | 4/5 | 4/5 | 4/5 | 4/5 |
| | | 9 | 4 | 4 | 0 | 0 | 0 |
| | II | 100 | 80 | 80 | 70 | 70 | 70 |
| | | 5 | 4/5 | 4/5 | 4/5 | 4/5 | 4 |
| | | 9 | 4 | 0 | 0 | 0 | 0 |
| | III | 100 | 80 | 80 | 70 | 70 | 70 |
| | | 5/6 | 4/5 | 4 | 4 | 4 | 3/4 |
| | | 9 | 4 | 1 | 0 | 0 | 0 |
| B-U-3P-3 | I | 100 | 80 | 80 | 70 | 70 | 70 |
| | | 5/6 | 5 | 4/5 | 4/5 | 4/5 | 4 |
| | | 9 | 4 | 4 | 4 | 0 | 0 |
| | II | 100 | 80 | 80 | 70 | 70 | 70 |
| | | 5 | 5 | 4/5 | 4 | 3/4 | 3/4 |
| | | 7 | 7 | 4 | 4 | 0 | 0 |
| | III | 100 | 80 | 80 | 70 | 70 | 70 |
| | | 5 | 4/5 | 4/5 | 4/5 | 4 | 3/4 |
| | | 4 | 4 | 4 | 4 | 4 | 0 |
| B-UU-3P-3 | I | 100 | 80 | 80 | 70 | 80 | 70 |
| | | 5 | 5 | 3/4 | 3/4 | 3/4 | 3/4 |
| | | 9 | 4 | 0 | 0 | 0 | 0 |
| | II | 100 | 80 | 80 | 70 | 70 | 70 |
| | | 5 | 5 | 5 | 4/5 | 4/5 | 3/4 |
| | | 9 | 0 | 0 | 0 | 0 | 0 |
| | III | 100 | 80 | 80 | 70 | 70 | 70 |
| | | 5 | 4/5 | 4/5 | 4/5 | 4/5 | 3/4 |
| | | 9 | 0 | 0 | 0 | 0 | 0 |
| B-U-3P-3* | IIIS | 100 | 80 | 80 | 80 | 70 | 70 |
| | | 5/6 | 5 | 4 | 4/5 | 4/5 | 4 |
| | | 9 | 7 | 4 | 4 | 4 | 0 |

*2 dip - 2 nip - strip ½" offset on 2nd pass
(1) WATER REPELLENCY
(2) OIL REPELLENCY
(3) PHOSPHATE-RESISTANCE

TABLE XVIII

WEARING TESTS - B FABRIC

| Fabric Identification | Sample Number | Original Reading | WEAR NUMBER - DREO - Hours 4 | 8 | 12 | 16 | 20 |
|---|---|---|---|---|---|---|---|
| B-1.5P-2 | I | 100 | 80 | 80 | 70 | 70 | 70 |
| | | 4/5 | 3/4 | 3/4 | 3/4 | 3/4 | 2 |
| | | 4 | 1 | 1 | 0 | 0 | 0 |
| | II | 100 | 80 | 80 | 70 | 70 | 70 |
| | | 3/4 | 2 | 2 | 2 | 2 | 2 |
| | | 0 | 0 | 0 | 0 | 0 | 0 |
| | III | 100 | 80 | 80 | 70 | 70 | 70 |
| | | 5 | 4/5 | 4/5 | 3/4 | 3/4 | 3/4 |
| | | 9 | 0 | 4 | 0 | 0 | 0 |
| B-U-1.5P-2 | I | 100 | 80 | 80 | 70 | 70 | 70 |
| | | 4/5 | 4/5 | 3 | 3 | 3 | 2 |
| | | 4 | 4 | 4 | 0 | 0 | 0 |
| | II | 100 | 80 | 80 | 70 | 70 | 70 |
| | | 4/5 | 4/5 | 3 | 3 | 3 | 2 |
| | | 9 | 4 | 4 | 0 | 0 | 0 |

TABLE XVIII-continued

| Fabric Identification | Sample Number | Original Reading | WEAR NUMBER - DREO - Hours 4 | 8 | 12 | 16 | 20 |
|---|---|---|---|---|---|---|---|
| | | WEARING TESTS - B FABRIC | | | | | |
| | III | 100 | 80 | 80 | 70 | 70 | 70 |
| | | 4/5 | 4/5 | 3/4 | 3/4 | 3/4 | 2 |
| | | 4 | 4 | 4 | 0 | 0 | 0 |
| B-1.5P-3 | I | 100 | 80 | 80 | 70 | 70 | 70 |
| | | 5 | 4 | 2 | 2 | 2 | 2 |
| | | 0 | 0 | 0 | 0 | 0 | 0 |
| | II | 100 | 80 | 70 | 70 | 70 | 70 |
| | | 5 | 4 | 3/4 | 3/4 | 3/4 | 3/4 |
| | | 4 | 4 | 0 | 0 | 0 | 0 |
| | III | 100 | 80 | 70 | 70 | 70 | 70 |
| | | 5 | 4 | 3/4 | 3/4 | 3/4 | 3/4 |
| | | 4 | 4 | 0 | 0 | 0 | 0 |
| B-U-1.5P-3 | I | 100 | 80 | 80 | 70 | 70 | 70 |
| | | 4/5 | 4/5 | 4/5 | 2 | 2 | 2 |
| | | 7 | 4 | 0 | 0 | 0 | 0 |
| | II | 100 | 80 | 80 | 70 | 70 | 70 |
| | | 4/5 | 4/5 | 4/5 | 2 | 2 | 2 |
| | | 4 | 4 | 0 | 0 | 0 | 0 |
| | III | 100 | 80 | 80 | 70 | 70 | 70 |
| | | 4/5 | 4/5 | 3 | 3 | 3 | 2 |
| | | 4 | 4 | 0 | 0 | 0 | 0 |

(1) WATER REPELLENCY
(2) OIL REPELLENCY
(3) PHOSPHATE-RESISTANCE

TABLE XIX

| Fabric Identification | Sample Number | Original Reading | Wear Number - DREO - Hours 4 | 8 | 12 | 16 | 20 |
|---|---|---|---|---|---|---|---|
| | | WEARING TESTS - B FABRIC | | | | | |
| B-0.5P-2 | I | 90 | 80 | 80 | 70 | 70 | 70 |
| | | 2 | 2 | 2 | 2 | 1 | 1 |
| | | 0 | 0 | 0 | 0 | 0 | 0 |
| | II | 90 | 80 | 80 | 70 | 70 | 70 |
| | | 3 | 3 | 2 | 2 | 1 | 1 |
| | | 0 | 0 | 0 | 0 | 0 | 0 |
| | III | 90 | 80 | 80 | 70 | 70 | 70 |
| | | 3 | 2 | 2 | 2 | 1 | 1 |
| | | 0 | 0 | 0 | 0 | 0 | 0 |
| B-U-0.5P-2 | I | 100 | 80 | 80 | 70 | 70 | 70 |
| | | 4 | 3 | 3 | 2 | 2 | 1 |
| | | 0 | 0 | 0 | 0 | 0 | 0 |
| | II | 100 | 80 | 80 | 70 | 70 | 70 |
| | | 4 | 4 | 3/4 | 2 | 2 | 1 |
| | | 0 | 0 | 0 | 0 | 0 | 0 |
| | III | 100 | 80 | 80 | 70 | 70 | 70 |
| | | 4 | 3 | 3 | 2 | 2 | 1 |
| | | 0 | 0 | 0 | 0 | 0 | 0 |

(1) WATER REPELLENCY
(2) OIL REPELLENCY
(3) PHOSPHATE-RESISTANCE

A subjective evaluation of the textile strip as it proceeded through the pad bath showed that it was completely wetted by the ultrasound before it left the bath, apart from lines which matched the location of the decoupling slots in the resonating horn. The lines averaged about ⅛" wide on the strip. These were more noticeable at the fast speed than the slow and were completely wetted by the liquid flow back from the padding rolls. One strip of the heavier material was run through twice at the fast speed (B-U-3P-3-111S). The second run was ½" offset so that the slot area did not coincide in each test. A higher solids pick-up was evident in this run and the wear test showed improved results.

Wearing tests are considered to be a good indication of durability of the imparted liquid-repellent properties. This is because the level of repellency exhibited during wearing depends not only on the even nature and the chemical structure of the outermost finish layer but also on how evenly the finish is distributed within the fabric. One would suspect from this test that the heavier fabric would show the greatest advantage from the ultrasonic treatment. This was not the case, however, possibly because the higher absorption of the ultrasound in the heavier fabric leads to a diminished cavitation activity in the vicinity of the transducer horn. The lighter fabric shows a very clear advantage, especially in phosphate resistance, in the use of ultrasound. Results at 1 foot/-second without ultrasound are similar to the results at 2 feet/second with ultrasonic energy, higher production rates are therefore possible with ultrasound in the tank. It is apparent from Table V that increased wettability is not due to increased speed. As mentioned before, wetting is almost instantaneous in the vicinity of the probe, therefore the pad bath can be shortened considerably. It thus appears possible to increase the concentration of water repellent material in excess of 3% by making the tank smaller and maintaining either the same or somewhat less total content of the expensive fluorochemical. In this way the advantage of higher concentration can be realized without increasing the reagent cost.

The embodiments of the invention in which an exclusive property or privilege is claimed are defined as follows:

1. A method for the treatment of textile fabric materials with a liquid finishing agent, said textile fabric being selected from the group consisting of nylon/cotton blends and polyester/cotton blends, comprising (a) providing an open-topped container for a bath of liquid finishing agent, (b) guiding the fabric material from a supply position downwardly into the container across a guide means including a stationary fabric-contacting surface disposed within said container, to immerse a portion of the length of said fabric material in the bath, (c) applying high frequency sonic energy to the bath at said stationary fabric-contacting surface at a power level and frequency such that effective cavitation occurs in the bath adjacent the immersed material, said frequency being in the range of 5–50 KHz and said power level expressed as power density at the fabric-contacting surface being in the range of 2–10 acoustic watts/cm$^2$, and drawing the fabric material through the bath and upwardly out of the bath.

2. A method according to claim 1, including the additional step of drawing the treated fabric through the nip of a mangle to remove excess liquid finishing agent.

3. A method according to claim 2, wherein the fabric to be treated is drawn through the bath and mangle once.

4. A method according to claim 3, including the additional steps of drying and curing the treated material.

5. A method according to claim 4, wherein the liquid finishing agent is a liquid repellent agent.

6. A method according to claim 1, wherein the liquid finishing agent is a solution comprising 10%/w of a fluoropolymer in water at room temperature.

7. A method according to claim 6, wherein the method is continuous.

8. A method according to claim 1, wherein said frequency is in the range of 20–25 KHz and wherein said power density is in the range 4–7 watts/cm$^2$.

9. A method according to claim 8, wherein the speed of travel of the fabric through the bath is about 30–60 cm/sec.

10. A method according to claim 9, wherein the liquid finishing agent is a solution comprising about 1.6 to 10%/w of a fluoropolymer in water at room temperature.

11. A method according to claim 10, wherein the solution additionally comprises about 2% by volume of isopropanol as wetting agent.

12. An apparatus for the treatment of fabric materials with a liquid finishing agent, comprising (a) an open-topped container for a bath of liquid finishing agent, (b) guide means including a stationary fabric-contacting surface disposed within said container, (c) means for drawing said fabric material from a supply position outside the container downwardly into the container across said fabric-contacting surface and upwardly out of the container, and (d) means for applying high frequency sonic energy to the bath at said stationary fabric-contacting surface, at a power level and frequency such that effective cavitation occurs in the bath adjacent the immersed fabric, said means for applying high frequency sonic energy including said fabric-contacting surface, and said frequency being in the range of 5–50 KHz and said power level expressed as power density at the fabric-contacting surface being in the range of 2–10 watts/cm$^2$;

ultrasonic generator means;

a plurality of matched, driven piezo-electric ceramic material transducers, electrically connected in parallel, said transducers being electrically connected to the generator means;

and resonating means for providing even motion amplitude high frequency sonic energy at said stationary fabric-contacting surface.

13. An apparatus according to claim 12, additionally comprising first roller means for supporting a supply of fabric material adjacent one end of the container;

a mangle adjacent the other end of the container for guiding the fabric material upwardly from the guide means and out of the container for removing excess liquid finishing agent;

means for lowering said guide means from an elevated position above the container, through the open top of the container, to an operating position within the container in which the portion of the length of the fabric material is immersed in the bath;

second roller means for collecting the treated fabric material; and drive means for drawing the fabric material through the apparatus.

14. An apparatus according to claim 12, wherein said fabric-contacting surface is a straight edge shaped to prevent tearing of the fabric and extends substantially across the width of the fabric.

15. An apparatus according to claim 14, additionally comprising a mangle for guiding the fabric material upwardly from said guide means and out of the container and for removing excess liquid finishing agent.

16. An apparatus according to claim 15, further comprising means for drying and curing the treated material downstream of said mangle.

17. An apparatus according to claim 16, wherein said means for drawing the fabric material is a variable speed electric motor operatively associated with said mangle.

18. An apparatus according to claim 12, wherein said frequency is in the range of 20–25 KHz and wherein said power density is in the range of 4 to 7 watts/cm$^2$.

19. An apparatus according to claim 7, wherein said ceramic material is lead zirconate titanate.

* * * * *